US009305526B1

(12) United States Patent
Kim

(10) Patent No.: US 9,305,526 B1
(45) Date of Patent: Apr. 5, 2016

(54) MULTI-TOOL FOR STRINGED INSTRUMENT

(71) Applicant: Hak Yeal Kim, Siheung-si (KR)

(72) Inventor: Hak Yeal Kim, Siheung-si (KR)

( * ) Notice: Subject to any disclaimer, the term of this patent is extended or adjusted under 35 U.S.C. 154(b) by 0 days.

(21) Appl. No.: 14/585,358

(22) Filed: Dec. 30, 2014

(30) Foreign Application Priority Data

Dec. 12, 2014 (KR) ..... 10-2014-0178956

(51) Int. Cl.
*G10G 7/00* (2006.01)
*G10D 3/00* (2006.01)

(52) U.S. Cl.
CPC ..... *G10D 3/006* (2013.01)

(58) Field of Classification Search
CPC ..... G01D 3/006
USPC ..... 84/458, 313; D8/16
See application file for complete search history.

(56) References Cited

U.S. PATENT DOCUMENTS

| | | | | |
|---|---|---|---|---|
| 6,294,719 | B1 * | 9/2001 | Palecki et al. | 84/458 |
| 2006/0130343 | A1 * | 6/2006 | Simcoe | 30/175 |
| 2007/0193430 | A1 * | 8/2007 | Jang | 84/313 |

FOREIGN PATENT DOCUMENTS

| | | |
|---|---|---|
| KR | 100194967 | 2/1999 |
| KR | 100858899 | 9/2008 |

* cited by examiner

*Primary Examiner* — Jianchun Qin
(74) *Attorney, Agent, or Firm* — Cantor Colburn LLP

(57) ABSTRACT

Disclosed herein is a multi-tool for a stringed instrument. The multi-tool has several tools, such as a puller, a tuning socket, a clipper, and a hexagonal tool, on a main body, so that it is unnecessary to separately carry respective tools in the case of replacing the string of the stringed instrument, thus affording easy portability and enhancing operational convenience. Further, the multi-tool is configured such that a receiving portion receiving a tuning handle therein is rotatably provided, thus enabling the tuning handle to be rapidly and conveniently rotated.

4 Claims, 6 Drawing Sheets

MULTI-TOOL FOR STRINGED INSTRUMENT

BACKGROUND OF THE INVENTION

1. Field of the Invention

The present invention relates, in general, to a multi-tool for a stringed instrument and, more particularly, to a multi-tool for a stringed instrument, which has several tools, such as a puller, a tuning socket, a clipper, and a hexagonal tool, on a main body, so that it is unnecessary to separately carry respective tools in the case of replacing the string of the stringed instrument, thus affording easy portability and enhancing operational convenience. Further, the invention is directed to a multi-tool for a stringed instrument, in which a receiving portion receiving a tuning handle therein is rotatably provided, thus enabling the tuning handle to be rapidly and conveniently rotated.

2. Description of the Related Art

Generally, stringed instruments configured to make sounds by the tension of strings, such as a cello, a guitar, or a violin, utilize various tools for adjusting the tension of the strings or replacing a part with another one.

As the related art, Korean Patent No. 10-0194967 has been proposed, which is entitled "Tightening Apparatus for Stringed Instrument".

This pertains to a tightening apparatus for a stringed instrument, in which a winding shaft of the tightening apparatus adjacent to a nut device is lengthened and a winding shaft of the tightening apparatus distant from the nut device is shortened by freely adjusting the length of the winding shaft, thus allowing an angle for a head portion of each string to become uniform and thereby enabling the same product to be used for several kinds of stringed instruments.

However, the conventional tightening apparatus is problematic in that it is configured to adjust the tension of the string of the stringed instrument, so that additional tools are required to replace the string with another one.

Therefore, in order to more conveniently and easily carry the tools, there has been proposed the related art, which may perform several functions of tools with a single apparatus.

As one example of the relate art, Korean Patent No. 10-0858899 has been proposed, which is entitled "Multi-functional Apparatus for Stringed Instrument for Replacing String with New one".

This relates to the multi-functional apparatus, which has a tuning socket and a cutter in one housing. The tuning socket receives a rotating force from an electric motor that is provided in the housing, thus automatically rotating a tuning handle of the stringed instrument.

However, the conventional apparatus is problematic in that it uses the electric motor, thus increasing a weight, and other tools (e.g., a screwdriver, a hexagonal wrench, a wrench, etc.) for replacing a part with another one are additionally required although the apparatus makes it easy to adjust the tension of the string and to replace the string with a new one. Hence, it is inconvenient to store various tools, and besides they may be undesirably lost.

The foregoing is intended merely to aid in the understanding of the background of the present invention, and is not intended to mean that the present invention falls within the purview of the related art that is already known to those skilled in the art.

DOCUMENTS OF RELATED ART (Patent Document 1) Korean Patent No. 10-0194967.

(Patent Document 2) Korean Patent No. 10-0858899.

SUMMARY OF THE INVENTION

Accordingly, the present invention has been made keeping in mind the above problems occurring in the related art, and an object of the present invention is to provide a multi-tool for a stringed instrument, which includes a puller for removing a bridge pin, a tuning socket for rotating a tuning handle, a clipper for cutting a string, and other tools on one main body, thus enhancing the convenience of use and preventing loss of various separate tools.

Another object of the present invention is to provide a multi-tool for a stringed instrument, in which, as a tuning socket is separated from a main body, a graduated ruler formed on the main body is exposed, thus having the function of a ruler, and which further includes a hexagonal tool having a hexagonal wrench and a screwdriver, and which includes a coupling member having a coupling hole that has the same shape as the appearance of the hexagonal tool, thus ensuring firm fixing without rotation even if the hexagonal tool is provided in the coupling hole.

A further object of the present invention is to provide a multi-tool for a stringed instrument, in which a tuning socket includes a receiving unit coupled with a tuning handle and a fitting unit inserted into a main body, and a rotating axis of the fitting unit is spaced apart from a central axis of the receiving unit, thus easily transmitting a force and allowing the tuning handle to be easily rotated.

In order to accomplish the above objects, the present invention provides a multi-tool for a stringed instrument, including a main body including first and second body parts coupled to each other via a rotating shaft portion; a puller provided on a first end of the main body, thus removing a bridge pin from the stringed instrument; a tuning socket including a fitting unit having a fitting portion into which a second end of the first body part is fitted, and a receiving unit provided on an end of the fitting unit and having a receiving portion in which a tuning handle is received; and a clipper provided on a first side of the main body, thus cutting a string. A graduated ruler is provided on the second end of the first body part fitted into the fitting portion, so that the graduated ruler is exposed when the tuning socket is detached from the first body part.

As is apparent from the above description, the multi-tool for the stringed instrument according to the present invention is advantageous in that one main body embraces all of the puller removing the bridge pin from the stringed instrument, particularly the guitar; the tuning socket rotating the tuning handle; and the clipper cutting the string. Therefore making it unnecessary to individually possess the respective separate tools, thus decreasing the risk of loss, offering easy portability, and improving work convenience.

Further, the multi-tool is advantageous in that the main body is composed of the first body part and the second body part, and the first body part is provided with the fitting unit to detachably attach the tuning socket thereto, and the graduated ruler is provided on an end of the first body part to realize the function of the ruler when the fitting unit is eliminated, thus making it convenient to measure the numerical values, such as the length of the string.

Furthermore, the multi-tool is advantageous in that, as the hexagonal tool having the hexagonal wrench and the screwdriver is coupled to the second body part, it is possible to use the hexagonal wrench and the screwdriver, and, as the coupling hole to which the hexagonal tool is coupled has the same shape (preferably the hexagonal shape) as the hexagonal tool, the hexagonal tool is firmly mounted, and the hexagonal tool is not rotated in the mounted state, so that there is no interference even when other tools are used, thus enhancing the convenience of use.

That is, the multi-tool is advantageous in that various tools are provided in one main body, thus allowing all the functions of the respective tools to be implemented. Simultaneously, its structure is simple, thus enhancing the convenience of use and the ease of portability, in addition to preventing the risk of loss.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF PREFERRED EMBODIMENTS

Figure 1:
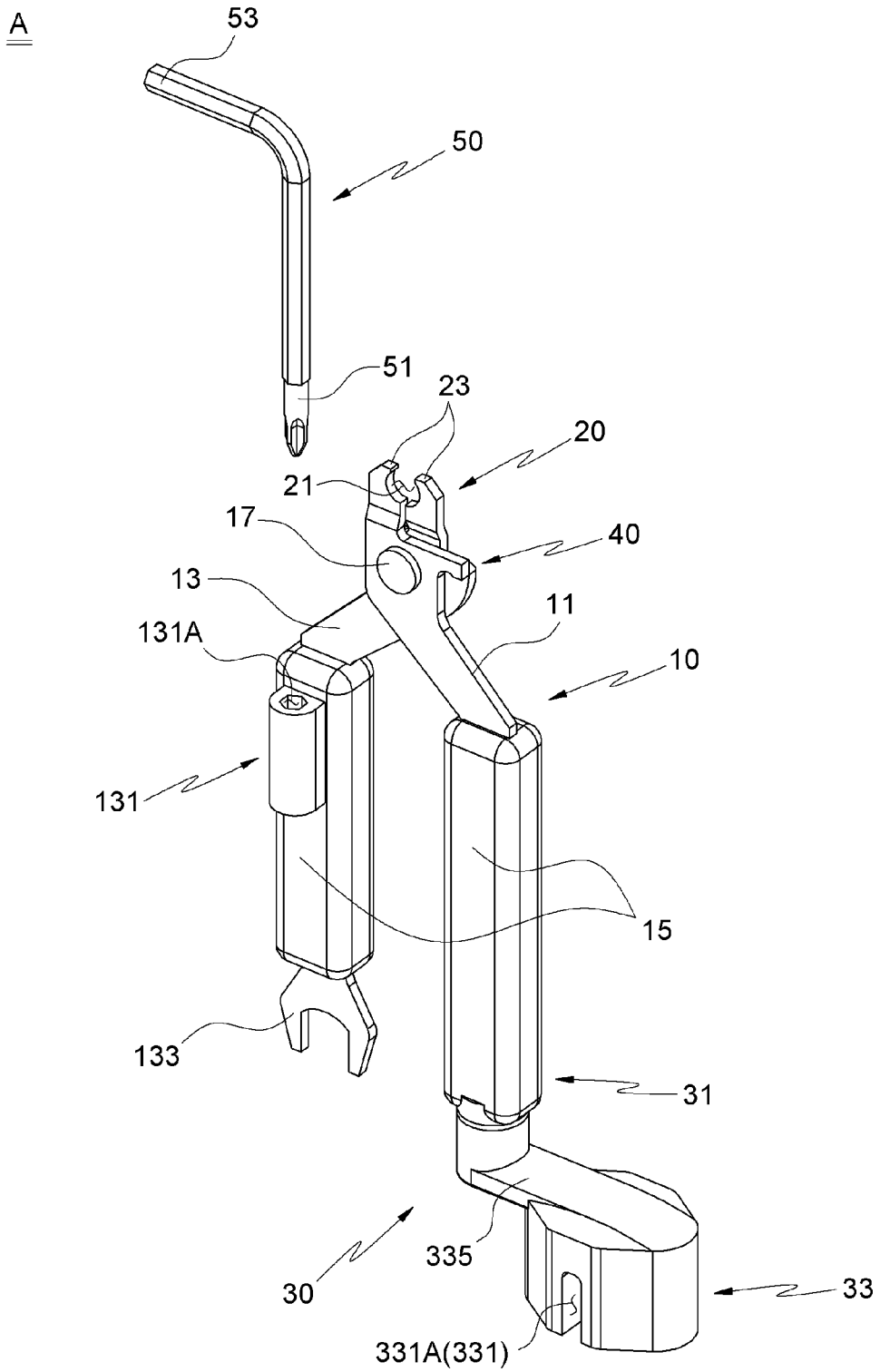
FIG. 1 is a perspective view showing a multi-tool according to the present invention.

Hereinafter, the present invention will be described in detail with reference to the accompanying drawings.

Since the present invention may be variously changed and have several shapes, aspects (or embodiments) of the present invention will be described in detail herein. However, it should be understood that the present invention is not limited to a specific embodiment, but embraces all changes, equivalents, and substitutes within the technical idea and scope of the present invention.

The same reference numerals throughout the drawings, that is, the same reference numerals in a second digit and a first digit, or in a second digit, a first digit, and an alphabet character denote elements having the same or similar function. If there is no special mention, the members denoted by the reference numerals are to be comprehended as the members complying with the above-mentioned reference scheme.

For clarity and convenience of description, the size or thickness of components shown in the drawings may be expressed to be exaggeratedly large (or thick) or small (or thin), or may be simplified. Furthermore, it should not be interpreted that the scope of this invention is limited to this size or thickness.

Terms employed herein are for the purpose of description of particular aspects (or embodiments), and are not intended to limit the present invention. Further, the singular forms "a" and "an" include plural referents unless the context clearly dictates otherwise. In this description, it should be understood that terms such as "include" or "comprise" are inclusive of characteristics, numerals, steps, operations, components, parts or combination thereof, but are not exclusive of one or more different characteristics, numerals, steps, operations, components, parts or combination thereof.

Unless the context clearly defines otherwise, all terms or words used herein have the same meaning as common meanings understood by those skilled in the art. Terms defined in a dictionary are to be interpreted as having the same meaning as meanings used in the related art, and should not be interpreted ideally or excessively unless this application clearly defines otherwise.

First, a multi-tool A for a stringed instrument according to the present invention includes a main body 10, and a puller 20, a tuning socket 30, a clipper 40, and a hexagonal tool 50, all of which are provided on the main body 10.

In detail, the main body 10 is composed of a first body part 11 and a second body part 13. The first body part 11 and the second body part 13 are coupled to each other via a rotating shaft portion 17.

That is, the puller 20 is provided on the first ends of the first and second body parts 11 and 13, while handle portions 15 are provided on the second ends thereof. Thereby, when the handle portions 15 are pressed with respect to the rotating shaft portion 17, the puller 20 may be operated. Similarly to the puller 20, the clipper 40 may also be operated when the handle portions 15 are pressed.

Figure 2:
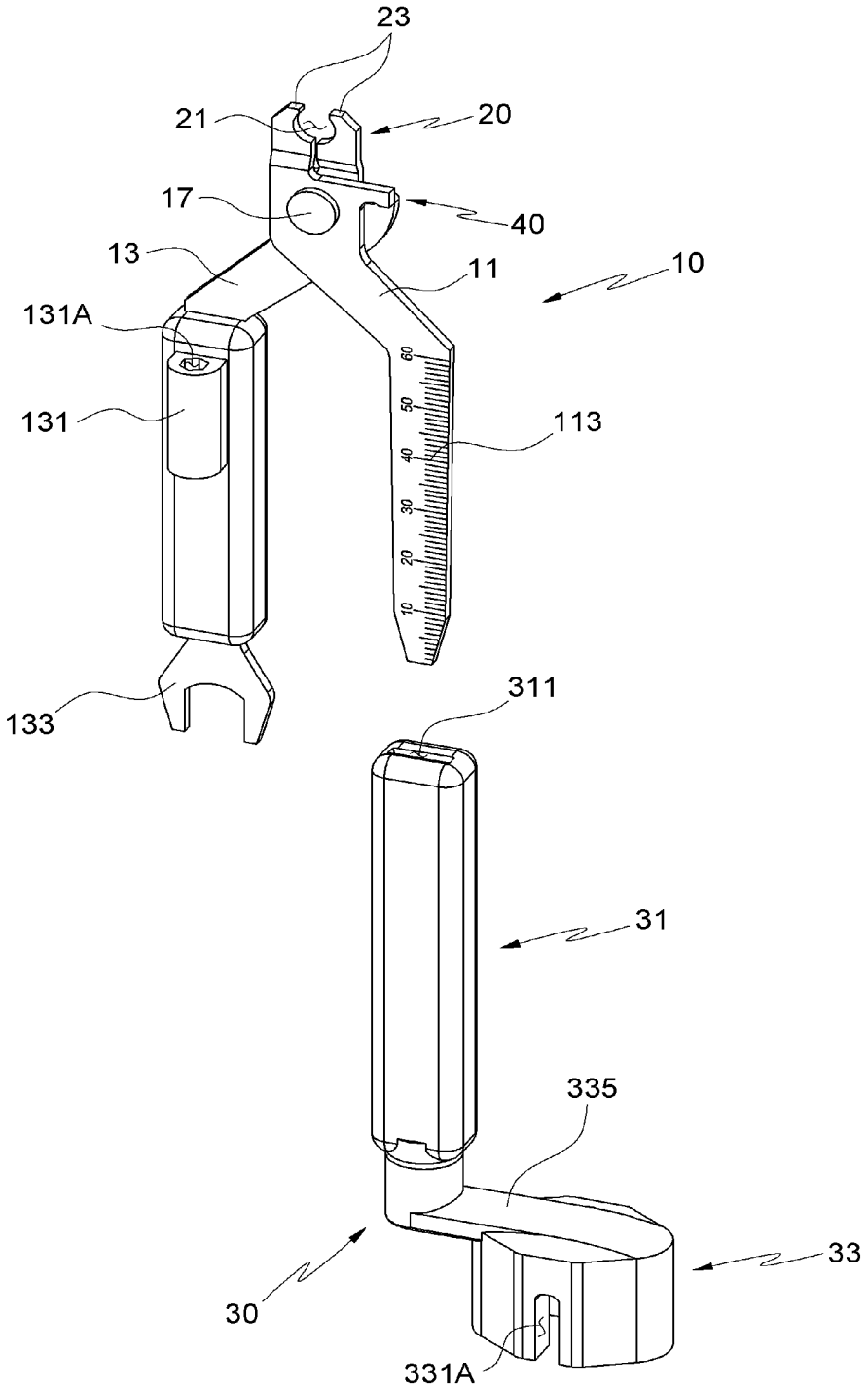
FIG. 2 is an exploded perspective view showing the multi-tool according to the present invention.
Figure 3A:
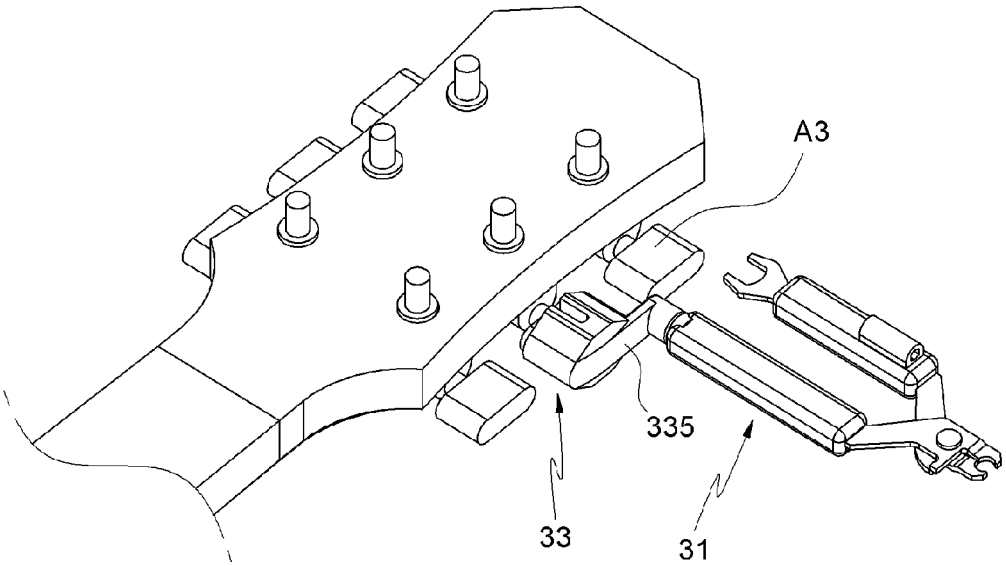
FIGS. 3A and 3B are views illustrating the use of a tuning socket of the multi-tool according to the present invention.
Figure 3B:
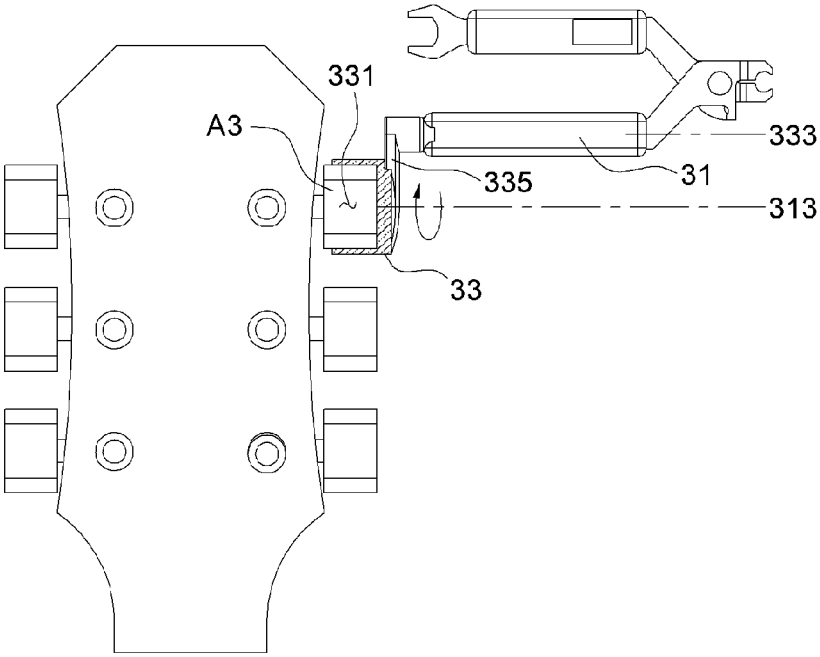

Again, the puller 20 will be described in more detail. As shown in FIGS. 1 and 2, puller parts are provided, respectively, on the first ends of the first and second body parts 11 and 13, thus defining one puller 20.

That is, a circular slot 21 is formed in the puller 20 to receive a head A2 of a bridge pin A1 therein, and pickup portions 23 are provided on opposing ends of the circular slot 21 to catch a portion between the bridge pin A1 and a body of the stringed instrument.

Figure 5:
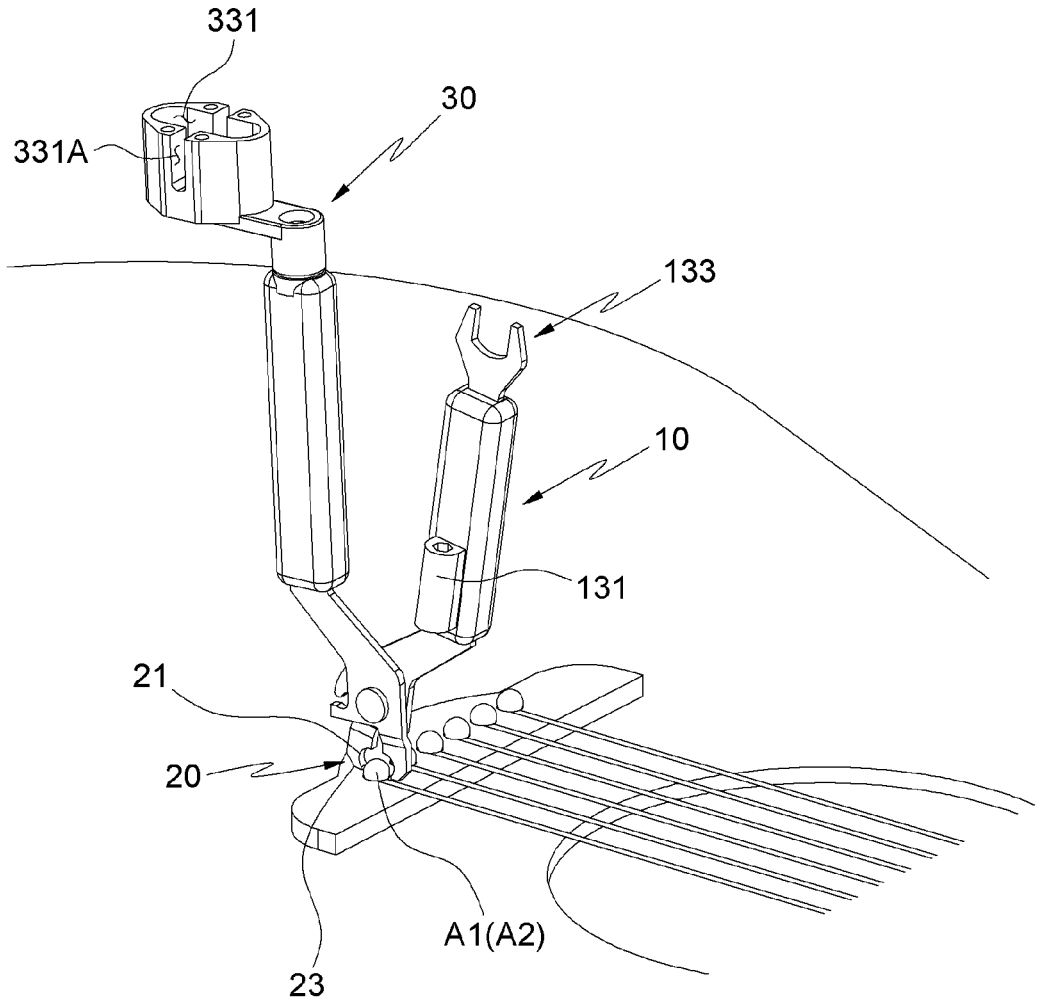
FIGS. 5 and 6 are views illustrating the use of a puller of the multi-tool according to the present invention.

Thus, as shown in FIG. 5, the puller 20 is vertically positioned relative to the bridge pin A1 which is provided on the stringed instrument, especially the guitar. The slot 21 is then opened to allow the pickup portion 23 to catch the portion between the bridge pin A1 and the body of the stringed instrument and thereby extract the bridge pin A1.

Here, the head A2 of the bridge pin A1 is located in the slot 21, thus allowing the pickup portions 23 to support the inside of the head A2 of the bridge pin A1 and thereby remove the bridge pin A1.

Preferably, when the handle portions 15 are completely pressed, the pickup portions 23 of the puller 20 are spaced apart from each other, thus preventing the bridge pin A1 from being damaged.

Further, the clipper 40 is provided on a first side of the main body 10 to cut a string A4 of the stringed instrument.

Figure 4:
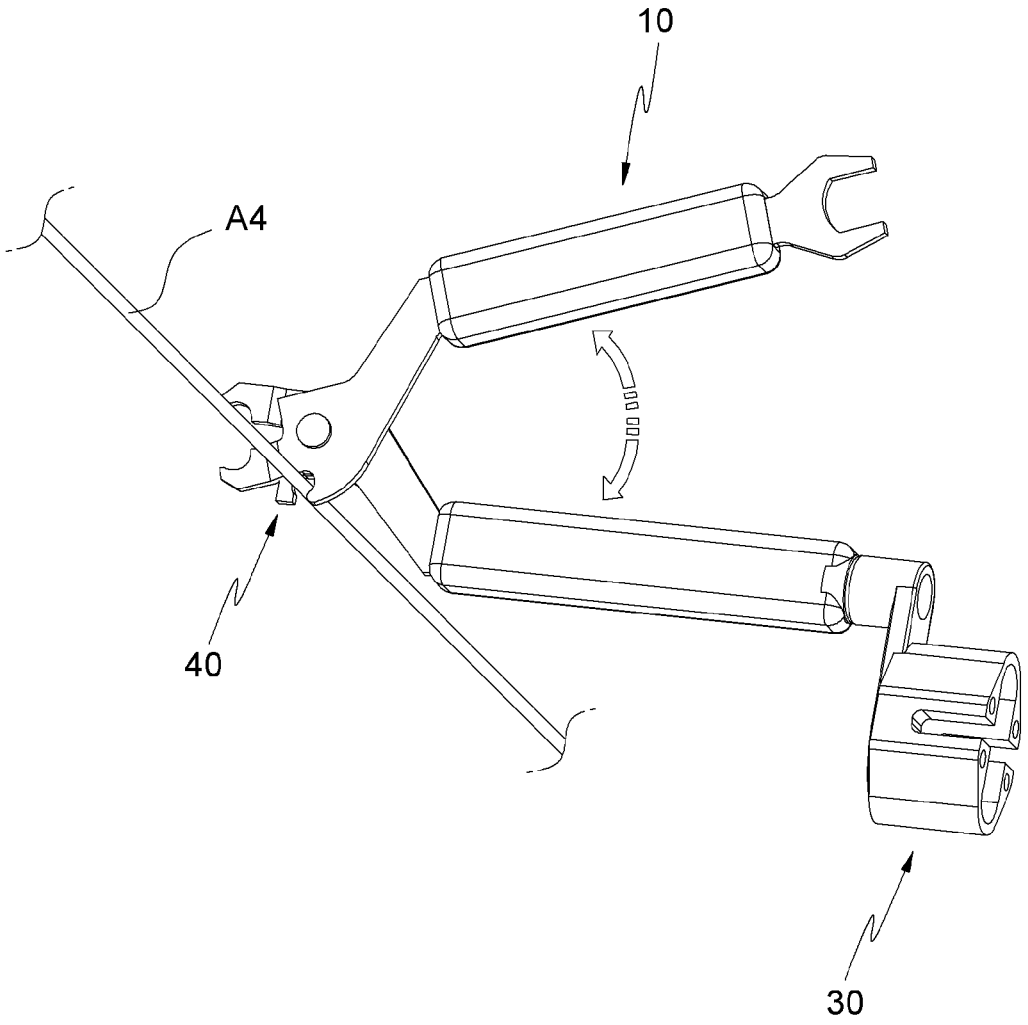
FIG. 4 is a view illustrating the use of a clipper of the multi-tool according to the present invention.

In more detail, as shown in FIGS. 1 and 4, the clipper 40 is provided on a side of a lower end of the puller 20. As mentioned above, the clipper 40 is operated with the movement of the handle portions 15.

That is, similarly to the puller 20, the clipper parts provided, respectively, on the first ends of the first and second body parts 11 and 13 define one clipper 40. If the handle portions 15 are pressed, the first and second body parts 11 and 13 come near to each other with respect to the rotating shaft portion 17, so that the clipper 40 is operated.

Further, the clipper 40 is a tool for cutting the string A4. If the handle portions 15 are completely pressed, the clipper 40 is completely closed unlike the puller 20. In this state, the clipper 40 may cut the string.

Turning back to FIGS. 1 and 2, the hexagonal tool 50 is coupled to the multi-tool A according to the present invention, one side of the hexagonal tool 50 being a screwdriver 51 and the other side thereof being a hexagonal wrench 53.

In more detail, a coupling member 131 is provided on the second body part 13 in such a way as to protrude from a surface thereof. A coupling hole 131A is formed in the coupling member 131.

Further, the hexagonal tool 50 has on one side thereof the screwdriver 51, particularly a phillips screwdriver 51, and has on the other side thereof the hexagonal wrench 53. An outer surface of the hexagonal tool 50 is formed in such a way that its cross section has a hexagonal shape. As shown in the drawing, it is preferable that the hexagonal tool 50 be bent in an 'L' shape.

Here, the hexagonal tool 50 is coupled to the coupling hole 131A. In order to prevent the hexagonal tool 50 from being rotated in the coupling hole 131A when the hexagonal tool 50 is coupled thereto, the coupling hole 131A preferably has a hexagonal shape, which is the same as the hexagonal tool 50.

Therefore, even if the puller 20, the clipper 40, or a tuning socket 30 that will be described below are operated in the state where the hexagonal tool 50 is coupled to the coupling hole 131A, the rotation or removal of the hexagonal tool 50 is prevented, thus enhancing work convenience. In addition, the coupling hole 131A preferably has various sizes depending on the hexagonal tool 50. Preferably, in order to ensure firm coupling, the coupling hole 131A is formed to have the same diameter as the hexagonal tool 50.

The multi-tool A according to the present invention further includes a wrench 133. The wrench 133 is provided on the second end (the end opposite to the end where the puller is provided, i.e. the lower end of the handle portion) of the second body part 13.

Moreover, as shown in FIGS. 1, 2, 3A, and 3B, the multi-tool A according to the present invention further includes the tuning socket 30.

Generally, the stringed instrument is provided with a tuning handle A3, and a string A4 is wound around the tuning handle A3. As the tuning handle A3 rotates, the tension of the string A4 is adjusted to set a tone. When one desires to replace the string with another one, the tuning handle A3 is rotated so as to wind or remove the string around or from the tuning handle A3.

In other words, the multi tool according to the present invention further includes the tuning socket 30 to easily rotate the tuning handle A3.

The tuning socket 30 includes a fitting unit 31 having a fitting portion 311 into which the second end of the first body part 11 is fitted, and a receiving unit 33 provided on the fitting unit 31 and having a receiving portion 331 in which the tuning handle A3 is received.

In more detail, the second end (handle portion) of the first body part 11 is coupled to the fitting unit 31. The fitting unit 31 has the fitting portion 311 formed therein, and the second end of the first body part 11 is coupled to the fitting portion 311. Here, the first body par 11 is removably coupled to the fitting unit 31.

Further, the receiving unit 33 is rotatably coupled to the fitting unit 31. In more detail, the receiving unit 33 further includes a connecting member 335. The connecting member 335 connects the fitting unit 31 with the receiving portion 331 to allow the receiving portion 331 to be spaced apart from the fitting unit 31.

To be more specific, the receiving unit 33 is provided with the connecting member 335. One end of the connecting member 335 is rotatably coupled to the fitting unit 31, while the other end is provided with the receiving portion 331 to receive the tuning handle A3 therein.

That is, a central axis 333 of the receiving unit 33 and a rotating axis 313 of the fitting unit 31 are spaced apart from each other via the connecting member 335. In the case of securing the tuning handle A3 to the receiving portion 331, as the fitting unit 31, namely, the main body 10 is rotated, the receiving unit 33 is naturally rotated, thus leading to the rotation of the tuning handle A3.

Preferably, the receiving portion 331 is further provided with an insert hole 331A, thus enabling the more smooth insertion and removal of the tuning handle A3.

Moreover, the tuning socket 30 is removably provided on the second end of the first body part 11. Here, a screwdriver 111, especially, a flat-head screwdriver 111 is formed on the second end of the first body part 11, with a graduated ruler 113 provided on a side thereof to function as a ruler.

That is, when the tuning socket 30 is separated from the first body part 11, the graduated ruler 113 and the (flat-head) screwdriver 111 are exposed to allow a user to use the function of both the ruler and the screwdriver. In contrast, when the tuning socket 30 is coupled to the first body part 11, the graduated ruler 113 and the screwdriver 11 are inserted into the fitting portion again.

Figure 6:
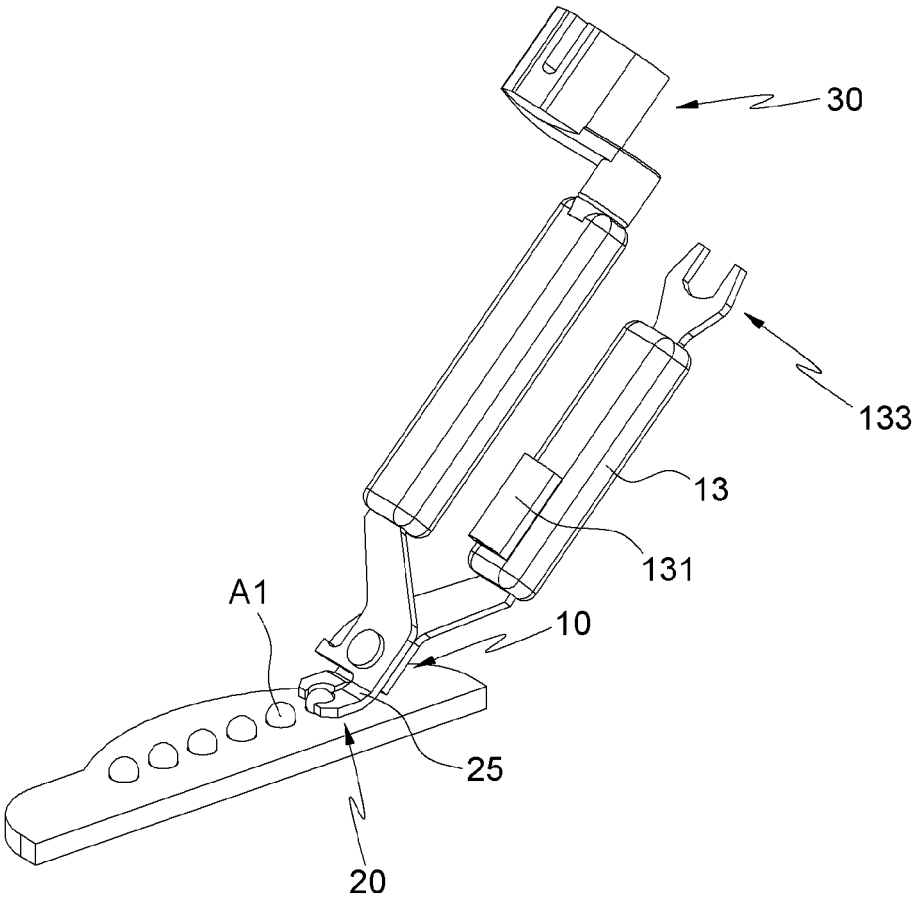

FIG. 6 illustrates a modification of the puller 20 according to the present invention. In the preceding embodiment, the puller 20 is positioned vertically relative to the bridge pin A1 so as to remove the bridge pin A1. However, according to this modification, the puller 20 may be configured to catch the bridge pin A1 from a side in order to enhance work efficiency.

That is, in order to couple the puller 20 to the side of the bridge pin A1, the puller 20 has a bent portion 25 which is provided on an end of the main body 10 in such a way as to be bent to a side.

Thus, if the handle portion 15 of the main body 10 is pressed towards the stringed instrument after the puller 20 catches a lower portion of the head from the side of the bridge pin A1, the bent portion 25 serves as the center of a lever, thus allowing a user to remove the bridge pin A1 with a smaller force.

As described above, the multi-tool A for the stringed instrument according to the present invention has, on one main body 10, the puller 20 for removing the bridge pin, the clipper 40 for cutting the string, the tuning socket 30 for rotating the tuning handle, the graduated ruler 113 serving as the ruler, the phillips screwdriver 51, the flat-head screwdriver 111, the wrench 133, and the hexagonal wrench 53, thus affording easy portability and enhancing the convenience of use.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A multi-tool for a stringed instrument, comprising:

a main body including first and second body parts coupled to each other via a rotating shaft portion, thus defining a handle portion;

a puller provided on a first end of the main body, thus removing a bridge pin from the stringed instrument;

a clipper provided on a first side of the main body, thus cutting a string; and a tuning socket including: a fitting unit having a fitting portion into which a second end of the first body part is fitted; and a receiving unit provided on the fitting unit and having a receiving portion in which a tuning handle is received, wherein a graduated ruler is provided on the second end of the first body part fitted into the fitting portion, so that the graduated ruler is exposed when the tuning socket is detached from the first body part, whereby, as the handle portion of the main body is pressed, the puller and the clipper are operated.

2. The multi-tool as set forth in claim 1, wherein the receiving unit of the tuning socket is rotatably provided on the fitting unit, and the receiving unit further comprises a connecting member, the connecting member connecting the fitting unit with the receiving portion to allow the receiving portion to be spaced apart from the fitting unit.

3. The multi-tool as set forth in claim 2, wherein a coupling member having a coupling hole is provided on the first body part, and a screwdriver is coupled to a first side of the coupling hole, and a hexagonal tool including a hexagonal wrench is coupled to a second side of the coupling hole, the coupling hole having the same shape as the hexagonal tool.

4. The multi-tool as set forth claim 1, wherein a coupling member having a coupling hole is provided on the first body part, and a screwdriver is coupled to a first side of the coupling hole, and a hexagonal tool including a hexagonal wrench is coupled to a second side of the coupling hole, the coupling hole having the same shape as the hexagonal tool.

* * * * *